United States Patent [19]

Fahnoe

[11] 4,186,365

[45] Jan. 29, 1980

[54] TRANSLUCENT HOUSING FOR A CIRCUIT INTERRUPTING DEVICE

[75] Inventor: Harold H. Fahnoe, Evanston, Ill.

[73] Assignee: S&C Electric Company, Chicago, Ill.

[21] Appl. No.: 837,235

[22] Filed: Sep. 27, 1977

[51] Int. Cl.[2] ..... H01H 85/30

[52] U.S. Cl. ..... 337/206; 337/241; 337/244

[58] Field of Search ..... 337/79, 241, 243, 206, 337/244; 335/17; 200/308, 317

[56] References Cited

U.S. PATENT DOCUMENTS

| | | | |
|---|---|---|---|
| 3,225,170 | 12/1965 | Chabala et al. | 200/308 |
| 3,852,556 | 12/1974 | Kane et al. | 335/17 |
| 3,924,216 | 12/1975 | Martin et al. | 337/206 |
| 4,016,384 | 4/1977 | Le Row, Jr. et al. . | |

*Primary Examiner*—George Harris
*Attorney, Agent, or Firm*—John D. Kaufmann

[57] ABSTRACT

An improved high-voltage fuse, the blown or unblown condition of which can be readily ascertained, is disclosed. Known fuses include a fusible element and a movable component, such as an arcing rod, which is held in a normal first position as long as the fusible element is present and remains intact. When the element fuses and arc is struck, the arcing rod moves through an arc-extinguishing medium to extinguish the arc, coming to rest in a second position. The fusible element, arcing rod, and arc-extinguishing medium are contained within an opaque, insulative housing for the fuse. In the improved fuse, the housing is made of an insulative material which is translucent. The housing's translucency is such that it may be difficult if not impossible to observe the condition of the fuse—blown or unblown—from the fuse's exterior. Accordingly, a member, mounted for movement with the arcing rod, is provided. The member is so configured and colored that an image thereof is readily visible through the translucent housing. The location of the image indicates the condition of the fuse. Facilitites may be associated with the housing to indicate the significance of the image location as it relates to fuse condition. These facilities may be an indicium, including lines or legends, which may bear a predetermined positional relationship to the member's image and which may instruct the observer of the significance of the location of the member image as it relates to the fuse's condition.

27 Claims, 4 Drawing Figures

TRANSLUCENT HOUSING FOR A CIRCUIT INTERRUPTING DEVICE

BACKGROUND OF THE INVENTION

1. Field of the Invention

The present invention relates to improved circuit interrupting devices, and more particularly to an improved high-voltage fuse, the condition of which is readily ascertainable without the use of special instruments or the removal of the fuse from its mounting.

2. Description of the Prior Art

High-voltage fuses of various types are well known. Such fuses contain both a fusible element which fuses, (or melts, vaporizes, or otherwise disintegrates) in response to an over-current condition and facilities for extinguishing the high-voltage arc which will be struck upon such fusing. The arc-extinguishing facilities generally include a movable component, often called an arcing rod or arcing terminal, which is normally restrained in a first position by attachment to an end of the fusible element as long as the fusible element does not fuse. The arcing rod is movable through or past a region or area which contains an arc-extinguishing medium or material. All of these items—the fusible element, the arcing rod, and the arc-extinguishing material—are normally contained within a hollow insulative housing. The housing is made of an insulative material having sufficient dielectric strength and length in view of the voltage at which the fuse is intended to be used and sufficient mechanical strength to withstand the handling incident to installation as well as the internal pressures resulting from the arc being struck at the time of circuit interruption. The ends of the housing are usually closed with metallic end caps or ferrules. These end caps are, when the fuse is in place, electrically connected to and mechanically held by an appropriate fuse mounting, thereby serially inserting the fuse in a circuit.

Upon an over-current condition arising in the circuit in which the fuse is inserted, the fusible element fuses and an arc is struck. This fusing permits facilities, usually a spring-like member, to move the arcing rod through or past the arc-extinguishing material. The usual arrangement of these types of fuses is such that the arc terminates on the arcing rod at or near the point of the former rod/element attachment and at or near a remote point formerly occupied by another end of the fusible element. The arc is thus drawn or elongated by the now-moving arcing rod so that it interacts with the arc-extinguishing material. Turbulent, cooling, deionizing gases are generated by this interaction between the arc and the arc-extinguishing material which ultimately cause arc extinguishment and circuit interruption. All of the above is well known.

Typically, the housing has been made of three types of materials. The housings of some early fuses were made of glass; this type of fuse, the so-called liquid-filled fuse, gave a ready indication of its condition because its interior was clearly visible. For reasons of economy, mechanical strength, and dimensional stability, however, later-developed fuses had housings of fiber-reinforced phenolic materials, of plastics or resins, or of a combination of these. These housings have proved to be more economical, stronger, and as good a dielectric as their glass predecessors. However, since non-glass housings are generally opaque, the condition of a fuse therewithin cannot be readily ascertained.

Various schemes were devised, in part to ameliorate this situation.

One such scheme involves a so-called dropout fuse. In this type of fuse, following movement of the arcing rod to extinguish the arc, the arcing rod is driven through and out one end of the fuse to trigger a latching mechanism on an upper fuse mounting. Triggering this latching mechanism permits the fuse to "drop out" and rotate downwardly on a lower hinge mounting, thus giving a visible indication that the fuse has operated.

In another scheme, an end of the arcing rod penetrates and protrudes externally from one end of the fuse following fuse operation to give a visual indication thereof via the protruding arcing rod end. This type of fuse may be termed an indicating fuse.

In a third type of fuse, however—the so-called solid material, non-dropout type—the arcing rod is moved by the pull of a tensioned coil spring. The coil spring coaxially surrounds a flexible cable which electrically connects the arcing rod to an upper fuse ferrule toward which it moves. Thus, the spring and cable are in the path of the movement of the arcing rod and prevent it from performing either a dropout function or an external indicating function. Present-day fuses of the non-dropout variety have opaque housings, as noted earlier. Thus, the condition of such fuses cannot be easily ascertained visually. Conditions of interest include the previous blowing of the fuse or the absence of crucial elements, such as the fusible element or arcing rod. Even with recent developments in the field of plastics and resins, materials electrically and mechanically suitable for use as fuse housings are not sufficiently transparent to permit convenient ascertainment of the condition of the fuse therewithin.

SUMMARY OF THE INVENTION

Thus, one object of the present invention is to provide an improved circuit interrupting device, which conforms substantially to present-day construction, the condition of which may be readily, visually ascertained.

Another object of the present invention is to provide an improved high-voltage, non-dropout fuse, the condition of which may be easily, visually ascertained without the need of extensive structural modifications of present-day fuse constructions.

With these and other objects in view, the present invention relates to an improved circuit interrupting device, such as a fuse, which includes a hollow insulative housing. A component is movable within the housing and is held in a first position as long as the device is able to conduct current, specifically, as long as the device has not operated (is in the unblown condition, if a fuse) and contains all necessary elements therefor. If the device operates (blows in the case of a fuse) or has some necessary elements missing, the component is in a second position. The improvement includes making the housing from a translucent material. Although the housing is translucent, the electrical and mechanical requirements thereof render it less than transparent. Such translucency, therefore, prevents readily, visually ascertaining the condition of the fuse within the housing. Specifically, the position of the component and the condition of the device are not readily visible through the housing. Accordingly, a member is provided having a location as a function of the component's position, that is, when the component is in the first position or the second position, the member is respectively in a first location or a second location. The member is so configured or shaped and so colored that its image is readily visible through the translucent housing from the device's exterior. The image's location gives a visible indication of the component's position, and, accordingly, of the device's condition.

Facilities may be provided for indicating the significance of the location of the member image, and therefore, for indicating both the presence and position of the component and the condition of the device. In one embodiment, these indicating facilities take the form of an indicium on the exterior of the housing. The indicium may be so located on the housing as to have a first predetermined positional relationship to the member image in the first location and a second predetermined positional relationship to the member image in the second location. The predetermined positional relationships may directly indicate the presence and position of the component and, by direct inference, the condition of the device. In another embodiment, the indicium includes a legend, lines, arrows, or the like. An appropriate legend may be adjacent the member image in the first location and set forth that the device has not operated, and/or be adjacent the second image location and set forth that the device has operated. Where lines are used, with or without legends, they may take the form of a frame-like pattern within which the image is positioned in one of its locations to directly indicate device condition.

In a preferred embodiment, the device is a high-voltage fuse, typically of the non-dropout type; and the movable component is on facilities for moving an arcing rod, the component being in the first position as long as a fusible element, normally within the housing, is both present and has not fused (or melted, vaporized, or otherwise disintegrated). If the fusible element is absent from the fuse, the component is in the second position. Similarly, upon fusing of the element, the arcing rod moves past or through an arc-extinguishing medium (and the component moves to the second position) thus extinguishing the arc which was struck following such fusing. In a more specfic preferred embodiment, the moving facilities include a spring normally in tension for biasing the arcing rod toward the second position. The member is a briliantly colored coating on a portion of the spring and an image of the coating is clearly visible through the housing. The housing includes a frame-like pattern within which the image is located following fusing of the element and movement of the arcing rod and of the coating. A legend on the housing advises that the presence of the member image within the pattern indicates that the fuse has operated or blown.

DETAILED DESCRIPTION OF THE INVENTION

Figure 1:
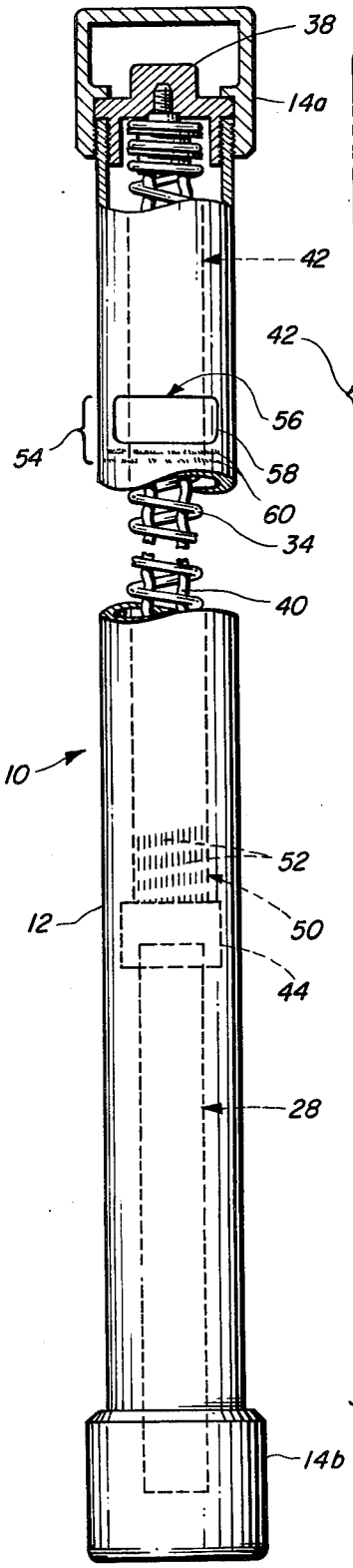
FIG. 1 is a view of the exterior of a fuse in an unblown condition according to the principles of the present invention.
Figure 2:
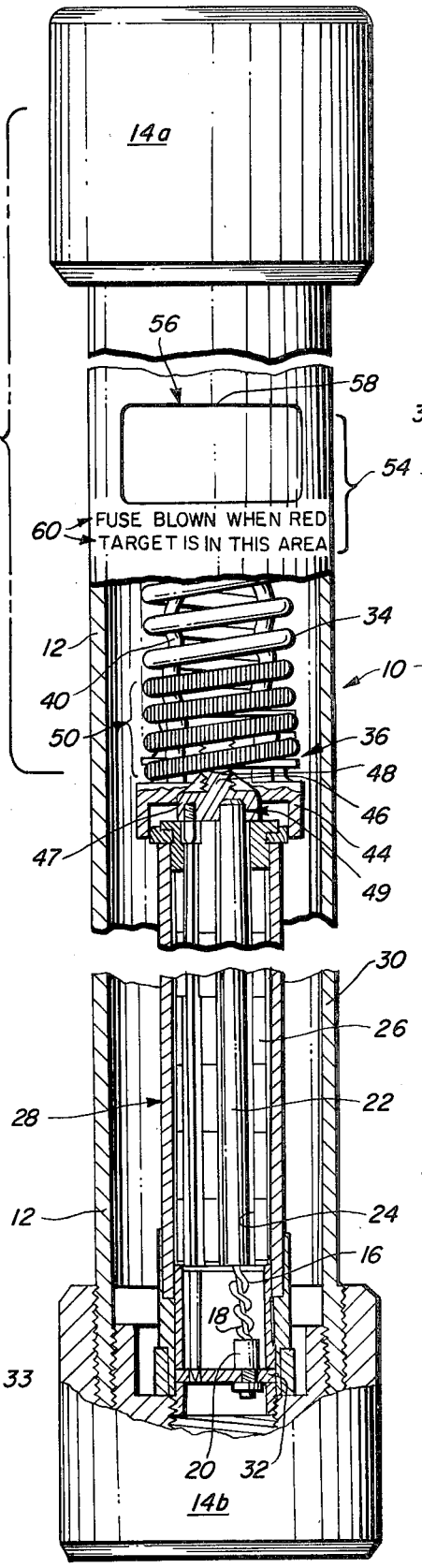
FIG. 2 is a view of the fuse in FIG. 1 following operation (blowing) or mishandling thereof or with certain elements thereof absent.
Figure 3:
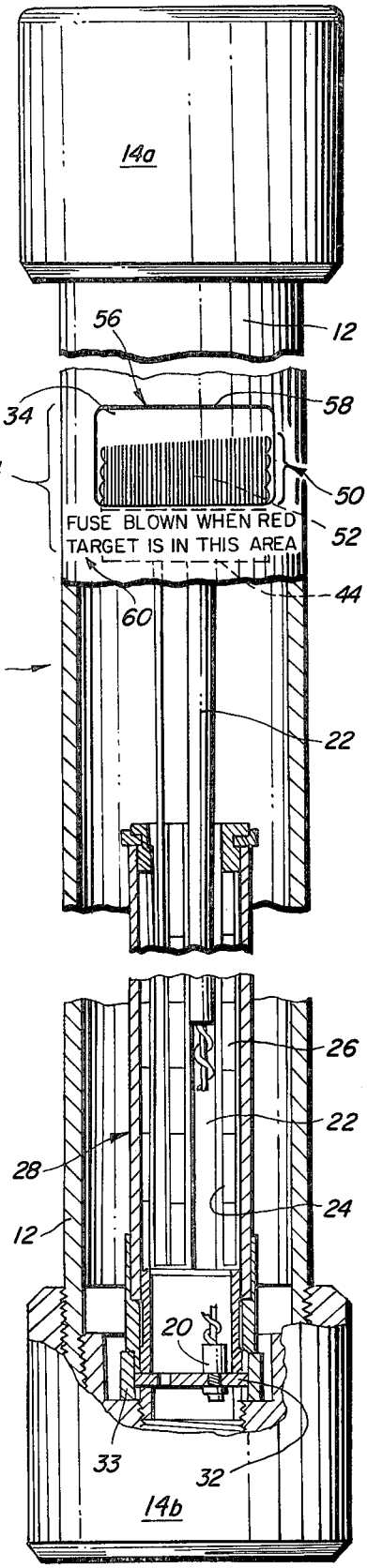
FIG. 3 is a partially broken-away view of the fuse in FIG. 1 taken along line 3—3 thereof.

Referring first to FIGS. 1-3, a circuit interrupting device, preferably a fuse generally indicated at 10, includes a hollow housing, tube or jacket 12, sometimes called a fuse holder. The fuse 10 is preferably, but need not be, a high-voltage fuse. Conveniently, the housing 12 is a right circular cylinder, but other shapes are contemplated. The housing 12 is made of a material having sufficient dielectric strength to withstand the voltages of the circuit in which the fuse 10 is intended to be used. Moreover, the housing 12 must be sufficiently mechanically strong to remain integral and intact during handling and installation of the fuse 10, as well as during the pressure build-up incident upon fuse operation and arc extinguishment where the fuse 10 is for high-voltage use. Also, according to the principles of the present invention, the housing 12 must be translucent.

There is no currently-available transparent, non-glass material which is both economically attractive for making fuse housings 12 and has the requisite electrical and mechanical properties. Moreover, until recently, most resins, plastics, or the like, available for use in housings 12 were completely opaque. Of late, materials have become available which are translucent; some light passes therethrough, but not enough light to permit visual observation of the condition of the fuse 10 within the housing 12. Attempts to render the housings 12 more translucent—or even transparent—have met with failure, because the necessary electrical, mechanical, or economic requirements of a fuse housing 12 have not been met.

Accordingly, a preferred material for the housing 12 is translucent, filament-wound, fiberglass-epoxy tubing having a wall thickness between about 0.3"-0.4", a range of about 0.365"-0.385" being preferred. The tubing has a light transmittance of at least about 40% and the following physical characteristics: tensile strength-7,500 psi; burst strength-90,000psi; and thread shear strength-2,400 psi. Appropriate tubing is available from IDSI Products, Inc., of North Tonawanda, New York; JANCO of Mishawaka, Indiana; and NVF of Yorklyn, DE.

The translucency of the housing 12 material is achieved in part by rendering the fiberglass filaments thereof more wettable than normal by the epoxy constituent prior to coating therewith. Moreover, during and/or after tube formation, excess air is removed from the tube prior to curing of the epoxy. In order to enhance the translucency of the housing 12, it is preferred to coat the exterior thereof with a clear, glossy coating, for example, of varnish. This coating enhances translucency in much the same manner as does water on frosted glass. While the material of the housing 12 does permit some light to pass therethrough, it still does not permit ready visual observation of the interior of the housing 12 or the condition of the fuse 10 therewithin due to its diffusion of that light. Any other materials having the requisite mechanical, electrical, physical and light transmittance properties as denoted above may also be used for the housing 12.

Each end of the housing 12 may be closed by an appropriate structure such as ferrules or end caps 14. For descriptive purposes, **14*a* designates an upper ferrule and 14*b* designates a lower ferrule, although the fuse 10 may have any desired orientation in use. The ferrules 14** may be conductive and may, for example, be copper plated with silver. Within the housing 12 is a fusible element 16. This element 16 may be any one of a number of well-known constructions and may include silver, tin, or other metals and combinations thereof. A strain wire 18 may also be included, as is well known. The fusible element 16 and the strain wire 18 are both electrically and mechanically connected at one end, as by brazing, to a stationary lower terminal 20, which in turn is electrically and mechanically connected to one of the ferruls 14*b*, by structure described below.

Referring now to FIGS. 2 & 3, preferably included within the housing 12 is a movable arcing rod 22. Additional arcing rods may be provided, and configurations other than that shown, as well as items known as arcing terminals, may be used, as is well known. Typically, the arcing rod 22 is an elongated, conductive metal rod, for example, silver-clad copper, movable along its major axis within the housing 12. One end of the arcing rod 22 is electrically and mechanically connected, as by brazing, to the other ends of the fusible element 16 and the strain wire 18. As long as the fusible element 16 and the strain wire 18 remain intact, movement of the arcing rod 22 is restrained thereby. Constructions other than that shown may be used to restrain the arcing rod 22 while the element 16 is intact.

The arcing rod 22 is contained in and is movable through a bore 24 formed in a body 26 of any one of a number of known arc-extinguishing materials. The positional relationship of the arcing rod 22 to the body 26 and its bore 24 may be other than that depicted.

For convenience in refusing a blown fuse 10, the fusible element 16, the strain wire 18, the lower terminal 20, the arcing rod 22, and the arc-extinguishing material 26, may all be self-contained in a refill unit 28. Conveniently, the refill unit 28 may take the form of a tube 30, typically of filament-wound fiberglass-epoxy. The lower terminal 20 is electrically and mechanically connected to a current transfer bridge 32 mounted in the tube 30 and which contacts a lower contact ferrule 33 closing one end of the tube 30. The lower contact ferrule 33 intimately contacts the lower ferrule 14*b* when the refill unit 28 is properly inserted into the housing 12.

Any one of a number of known facilities, such as a coil spring 34, may be provided within the housing 12 for biasing the arcing rod 22 away from the lower terminal 20. One end of the spring 34 is attached, as at 36, to the free end of the arcing rod 22. The other spring end is mounted to a cap 38 held in contact with the upper ferrule 14*a* to stretch and tension the spring 34 and bias the arcing rod 22 as described above. Compression springs or other devices obviously may be used instead of the tensioned coil spring 34 shown.

A cable 40, typically of copper and surrounded by the spring 34, may be electrically connected between the cap 38 and the point of attachment 36 between the spring 34 and the free end of the arcing rod 22. The cable 40 ensures electrical conductivity between the arcing rod 22 and the upper ferrule 14*a* in all positions of the arcing rod 22. Other structures, such as sliding contacts (not shown) engaging the arcing rod in all positions thereof, may be used in place of the cable 40.

To provide convenience similar to that provided by the refill unit 28, the spring 34, the cable 40, and the cap 38 may be provided in an integral assembly 42. In this event, the attachment 36 between the spring 34 and the cable 40, on the one hand, and the free end of the arcing rod 22, on the other hand, may take the form of a cap 44 attached to the spring 34 and cable 40 as part of the spring-and-cable assembly 42. The cap 44 is attached to a threaded portion 46 of an upper terminal 47 by any convenient means, such as by a threaded hole 48 to mount the refill unit 28 to the assembly 42. The upper terminal 47 forms a part of the refill unit 28 and is electrically and mechanically connected to the arcing rod 22, as at 49. Movement of the cap 44 and of the upper terminal 47 away from the lower contact 20 moves the arcing rod 22 away therefrom.

In use, the fuse 10 is inserted into a circuit (not shown) by appropriate mountings (not shown) which mechanically and electrically connect to and hold the ferrules 14*a* and 14*b*. Normally, the circuit is made via the following path: the upper ferrule 14*a*, the cap 38, the spring and cable assembly 42, the cap 44, the hole 48, the threaded portion 46 of the upper terminal 47, the arcing rod 22, the fusible element 16 and the strain wire 18, the lower contact 20, the bridge 32, the lower contact ferrule 33, and the lower ferrule 14*b*, as in FIGS. 1 & 2.

Should an over-current condition to which the fusible element 16 is sensitive occur, element 16 fuses (or melts, vaporizes, or disintegrates). Such fusing removes the restraint on movement of the arcing rod 22, and the spring 28, or other biasing means provided, moves the arcing rod 22 away from its first position near the lower contact 20. If the circuit is a high-voltage circuit, fusing of the element 16 is immediately followed by the striking of a high-voltage arc between the lower contact 20 and the end of the arcing rod 22 which was formerly connected to the fusible element 16. As the arcing rod 22 moves, it draws and elongates the arc through the bore 24 in the arc-extinguishing material 26. The arc interacts in a known manner with the arc-extinguishing material 26 to ultimately extinguish the arc. The arcing rod 22, the cap 44, and the upper terminal 47 all come to rest at second positions (remote from their first positions) whereat the spring 28 is fully collapsed as shown in FIG. 3.

If the fusible element 16 and the strain wire 18 cease to be intact for reasons other than an over-current condition, for example, because the fuse 10 is dropped during handling the impact of which breaks them, the arcing rod 22 moves and the spring 28 collapses. Moreover, if the refill unit 28 is absent from the housing 12, the spring 42 is in its fully collapsed condition. Neither of these latter two fuse conditions are accompanied by arc-extinguishment, but both result in the cap 44 occupying the second position, as described above. In view of the above discussion, the present invention contemplates the use of a "movable component" the position of which is indicative of the numerous conditions of the fuse 10 or other device. "Movable component" as used herein means, without limitation, the arcing rod 22, the spring 34, the cable 40, the cap 44, or the upper terminal 47, for example.

As noted, the material of the housing 12, although translucent, is such that the position or presence of none of the items therewithin—the arcing rod 22, the fusible element 16, the spring 42, or the cap 44, for example—are readily visible therethrough. Thus, an observer cannot easily determine if the fusible element 16 and the strain wire 18 are intact or even present, and specifically whether the fuse 10 has operated, has been mishandled, or has been properly assembled. Thus, it is difficult to determine whether the above-described over-current condition has occurred, and, if there are a plurality of fuses 10 adjacently mounted, which of the fuses 10 may have operated.

Accordingly, referring to FIGS. 1-3, a member 50 is provided for movement with the arcing rod 22, the terminal 47, or the cap 44. The member 50 may take the form of a "flag" or "target," and is shown as a brilliantly-colored area on the spring 34 adjacent the cap 44. The member 50 could well be, depending on the specific fuse construction, a colored area on, or a separate colored member attached to, the arcing rod 22, the upper terminal 47, the cap 44, the cable 40, the attachment point 36, or the coupling 48. The member 50 is made of a sufficient size (or to have a sufficiently peculiar outline) and is also so colored that an image 52 (FIGS. 1 and 3) thereof is easily visible through the translucent housing 12 to an observer on the outside thereof. The member 50 serves as a "flag" or "target" in that its shape and color are so selected, relative to the translucent properties and coloration of the housing 12, as to present an easily visible image 52 therethrough.

Given the preferred material of the housing 12, noted above, it has been found that the member 50 should have a size substantially larger than the arcing rod 22 and should be colored a vivid color, such as orange or red, to be easily discerned through the translucent housing 12. Preferable, the member 50 comprises a coating of DAY-GLO No. 202-14 fire orange acrylic lacquer on a coating of DAY-GLO No. 653010 white primer, both available from DuPont. These coatings are applied to the bottom three or four turns of the spring 34 to produce a vivid orange member 50 approximately ½"high and 1" wide (the approximate diameter of the spring 34.) The DAY-GLO orange preferred has high reflectivity and a color which sharply contrasts with the natural coloration of the housing 12. Of course, other sizes, shapes, colors, and materials for the member 50 will be apparent to those skilled in the art. For example, a colored ring or tape could surround the spring 34 or the cap 44 and be attached to either.

When the arcing rod 22, the cap 44, the terminal 47 and the lower portion of the spring 34 are in their first positions, and the refill unit 28, including the fusible element 16, is intact and present, the member 50 occupies a first location (FIGS. 1 and 2). Similarly, when the arcing rod 22 has moved to the second position following fusing or other breakage of the fusible element 16 and the strain wire 18, or if the refill unit 28 or the fusible element 16 is absent, the member 50 is in a second location (FIG. 3). Because of its shape, size, and color, the location of the member 50 is easily visible via its image 52 in at least the second location, and preferably at all locations thereof corresponding to all positions of the arcing rod 22, the cap 44, and the terminal 47, as shown in FIGS. 1 and 2. Moreover, merely mounting the refill unit 28 to the assembly 42 in the housing 12 without doing more, automatically places the member 50 and its image 52 in their first locations.

According to a preferred embodiment (FIGS. 1-3) included are means 54 for indicating the significance of the location of the image 52 of the member 50. This means may indicate that the fusible element 16 is present, or if present is intact (the fuse 10 has not operated and has not been mishandled), and/or that the fusible element 16 is not intact (the fuse 10 has operated, has been mishandled, or is absent) depending on the location of the image 52.

A preferred form taken by the indicating means 54 is an indicium 56 on the exterior of the housing 12. The indicium 56 may take any one of a number of forms. For example, a frame-like pattern 58 may be formed on the housing 12, within which the image 52 of the member 50 is framed after the arcing rod 22 has moved to the second position (FIG. 3) following fuse operation, i.e., following fusing of the fusible element 16. Contained within or adjacent to the pattern 58 may be a legend 60 indicating that the presence of the image 52 of the member 50 within the pattern 58 indicates that the fuse 10 has operated, or "blown" and thus, that the fusible element 16 has fused, or is otherwise not intact or not present. A typical legend is "Blown. . .when [color of the member 50, here orange or red] target is in this area," or "Fuse Operated" or the like. Of course, the legend 60 may alternatively, or in addition, inform that the presence of the member image 52 in a location other than the second location indicates the fuse 10 has not operated and is properly assembled. Other lines, patterns, arrows, or the like, may serve the same function as the pattern 58, as should be obvious. Moreover, a legend 60 by itself, without the use of the frame 58 or arrows and lines, could similarly be used.

Figure 4:
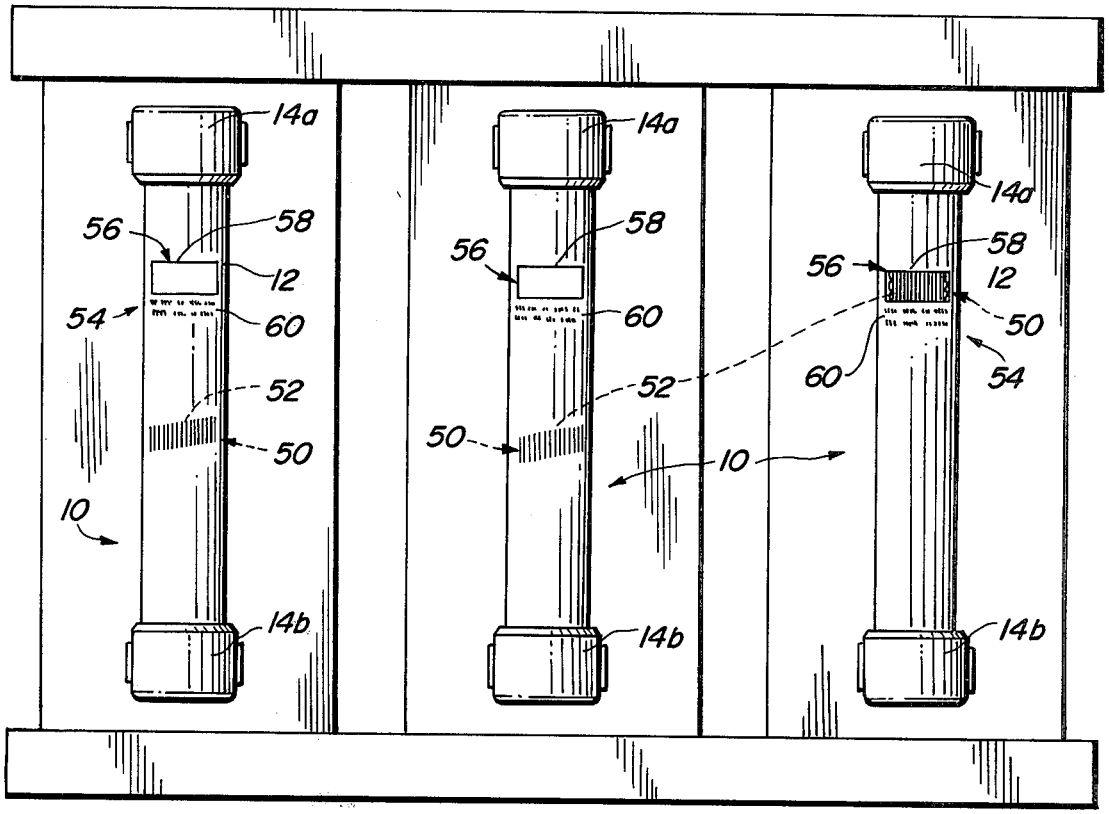
FIG. 4 is a front elevation of three fuses according to the present invention, two of the fuses being unblown and one of the fuses having operated, or having been mishandled.

It has been shown that the use of the fuse 10 constructed as described above permits ready and easy ascertainment of the condition of the fuse 10. Specifically, under normal conditions of illumination, the image 52 of the member 50 is easily discernable through the translucent housing 12 and the appropriate placement of the indicium 56 can be easily calculated to provide a rapid, easy indication of the condition of the fuse 10. Moreover, under low light conditions, a flashlight or the like may be used at a distance to illuminate the housing 12 in the viscinity of the first and second image 52 locations so as to permit easy ascertainment of fuse 10 condition. Additionally, as shown in FIG. 4, the side-by-side (or other predeterminedly aligned) mounting of a plurality of the fuses 10 provides both easy determination of the condition of each fuse 10 and a quick, simultaneous comparison of the various conditions thereof by compairing the relative positions of the images 52 of the members 50.

Although certain specific embodiments of the invention are described in the foregoing detailed description, it should be understood that this invention is not limited to those specific embodiments, but is capable of modification and re-arrangement. For example, the present invention is usable with other circuit interrupting devices, such as fuses of constructions other than that shown, portable loadbreak tools, or the like, in which it may be desired to externally, visually determine the position of a movable member to indicate the condition or presence of contacts therein or the location or presence of the operating components thereof. Such other circuit interrupting devices may have internal structures other than that described, and need not contain, for example, an arcing rod 22 in the exact configuration described. All that is necessary is that the circuit interrupting device be of a type wherein a component moves from a first position to a second position upon operation thereof, upon some mishandling condition, or upon improper assembly thereof.

What is claimed is:

1. An improved circuit interrupting device of the type including a hollow insulative housing with a movable component within the housing which is in a first position or a second position as a function of the condition of the device, wherein the improvement comprises:

the housing being so translucent that, although the interior of the housing, including the component in one or both of its positions, is vaguely discernible from the exterior thereof, neither the position of the component nor, accordingly, the condition of the device, are accurately, visually determinable through the housing from the exterior thereof; and a member having a first location or a second location as a function of the position of the component, the member being so configured and colored that an image thereof in the second location is readily visible through the translucent housing from the exterior thereof, the presence or absence of the member image at the second location indicating the presence or absence of the component at the second position.

2. The improved device of Claim 1, which further comprises means for indicating the significance of the member image locations as it relates to the condition of the device.

3. The improved device of Claim 2 wherein the indicating means includes an indicium on the exterior of the housing and visible therefrom.

4. The improved device of Claim 3 wherein the indicium includes a legend setting forth the condition of the device indicated by one of the member image locations.

5. The improvement set forth in Claim 4, wherein the device is a fuse normally including a fusible element, and the component is in the second position when the fusible element ceases to be intact or is absent from the housing.

6. The improved device of claim 3 wherein the indicium is so located as to have a first, predetermined, positional relationship to the first member image location, and a second, predetermined, positional relationship to the second member image location.

7. The improved device of claim 6 wherein the indicium includes a frame-like pattern within which the member image is framed at one of the locations.

8. The improved device of claim 7 wherein the indicium further includes a legend setting forth the condition of the device indicated by the presence or absence of the member image within the pattern.

9. The improved device of claim 8 wherein the legend is adjacent the pattern.

10. The improved device of claim 8 wherein the legend is within the pattern.

11. The improvement set forth in claim 8 wherein the device is a fuse normally including a fusible element, and the component is in the second position when the fusible element ceases to be intact or is absent from the housing.

12. An improved fuse of the type including a hollow insulative housing and a movable component within the housing, the component being in a first position as long as a fusible element is present in the housing and remains intact, the component being in a second position as a function of the fusible element being absent or ceasing to be intact; wherein the improvement comprises:

the housing being translucent, the positon of the component and the intactness and presence of the fusible element, being not readily visible through the housing from the exterior thereof; and a member in a first location or a second location as a function of the position of the component in the first position or the second position, the member being so configured and colored that an image thereof in the second location is readily visible through the translucent housing from the exterior thereof, the presence or absence of the member image in the second location indicating both the presence or absence of the component in the second position and the intactness and presence of the fusible element.

13. The improvement of claim 12, wherein the fuse is a high-voltage fuse further including an arcing rod movable relative to an arc-extinguishing medium for extinguishing an arc incident upon fusing of the fusible element in response to an over-current through the fuse; and means responsive to the fusing of the fusible element for moving the arcing rod; the component being on the moving means and being in the second position if the fusible element fuses.

14. The improved fuse of claim 13, which further comprises means for indicating the significance of the member image location as it relates to the condition of the fuse.

15. The improved fuse of claim 14 wherein the indicating means includes an indicium on the exterior of the housing and visible therefrom.

16. The improved fuse of claim 15 wherein the indicium includes a legend setting forth the condition of the fuse indicated by one of the member locations.

17. The improved fuse of claim 15 wherein the indicium is so located as to have a first, predetermined, positional relationship to the first member image location and a second, predetermined, positional relationship to the second member image location.

18. The improved fuse of claim 17 wherein the indicium includes a frame-like pattern within which the member image is framed at one of the locations.

19. The improved fuse of claim 18 wherein the indicium further includes a legend setting forth the condition of the fuse indicated by the presence of the member image within the pattern.

20. The improved fuse of claim 19 wherein the legend is adjacent the pattern.

21. The improved fuse of claim 19 wherein the legend is with the pattern.

22. The improved fuse of claim 18 wherein the indicium further includes a legend setting forth the condition of the fuse indicated by the absence of the member image from within the pattern.

23. An improved high-voltage fuse of the type including a hollow insulative housing; a fusible element in the housing connected to and restraining the movement of an arcing rod mounted for movement in the housing; and means for moving the arcing rod our of a first position relative to an arc-extinguishing material in response to fusing of the fusible element to thereby extinguish an arc incident upon such fusing; wherein the improvement comprises:

the housing being translucent, the fusible element, the arcing rod, and the moving means being not readily visible through the housing from the exterior thereof;

a member movable out of a first location in response to movement of the arcing rod out of the first position, the member being so colored and configured that an image thereof is readily visible through the housing from the exterior thereof; and means for indicating the significance of the member image location as it relates to the condition of the fusible element.

24. The improved fuse of claim 23 wherein
the indicating means includes an indicium on the housing exterior; and
the member is brilliantly-colored and is on the arcing rod moving means.

25. The improved fuse of claim 24 wherein:
the indicium includes
a frame-like pattern within which the member image is framed if the fusible element has fused, and
a legend setting forth the condition of the fuse indicated by the presence of the member image within the pattern;
the arcing rod moving means includes a spring normally under tension to bias the arcing rod out of the first position; and
the brilliantly-colored member includes a coating on a portion of the spring.

26. The improved fuse of Claim 25 wherein
the housing is filament-wound fiberglass epoxy having a light transmittance of at least about 40%, the housing having a clear glossy coating on the exterior thereof; and
the coating includes an orange acrylic lacquer.

27. An assemblage of a plurality of the improved devices set forth in claim 1 wherein the devices are mountable in a predetermined relative alignment so that the second image locations of the devices also have a predetermined relative alignment which renders the presence or absence of the various member images in the second location simultaneously readily visible.

* * * * *